US006815679B2

(12) United States Patent
Azuma

(10) Patent No.: US 6,815,679 B2
(45) Date of Patent: Nov. 9, 2004

(54) REVERSIBLE THERMAL RECORDING MATERIAL AND METHOD OF RECORDING IMAGE ON REVERSIBLE THERMAL RECORDING MATERIAL

(75) Inventor: Yoichiro Azuma, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 0 days.

(21) Appl. No.: 10/361,867

(22) Filed: Feb. 11, 2003

(65) Prior Publication Data

US 2003/0166467 A1 Sep. 4, 2003

(30) Foreign Application Priority Data

Feb. 13, 2002 (JP) ..... 2002-035351
Feb. 26, 2002 (JP) ..... 2002-048984
Feb. 26, 2002 (JP) ..... 2002-048985

(51) Int. Cl.[7] ..... B41M 5/20; B41M 5/24; G03C 5/00

(52) U.S. Cl. ..... 250/316.1; 503/204; 503/213; 503/216; 503/217; 503/218; 430/332; 430/338; 430/339; 430/340; 430/351

(58) Field of Search ..... 503/204, 213, 503/216–218; 430/332, 351, 338–340, 162, 200, 270.1, 302; 250/316.1

(56) References Cited

U.S. PATENT DOCUMENTS 5,568,170 A * 10/1996 Hirano et al. ..... 347/51
5,604,566 A * 2/1997 Mano et al. ..... 355/70
5,858,604 A * 1/1999 Takeda et al. ..... 430/162
5,879,855 A * 3/1999 Schadeli et al. ..... 430/270.1
5,948,727 A 9/1999 Hotta et al.
6,040,108 A * 3/2000 Schadeli et al. ..... 430/200
6,172,001 B1 * 1/2001 Hotta et al. ..... 503/201
6,180,315 B1 * 1/2001 Schadeli et al. ..... 430/200
6,235,445 B1 * 5/2001 Nakamura et al. ..... 430/200
6,404,335 B1 * 6/2002 Ohno et al. ..... 340/505
6,596,464 B2 * 7/2003 Van Damme et al. ..... 430/302
2002/0025489 A1 * 2/2002 Shimada et al. ..... 430/270.1
2002/0136988 A1 * 9/2002 Van Damme et al. ..... 430/302
2002/0168579 A1 * 11/2002 Suzuki et al. ..... 430/7
2003/0099902 A1 * 5/2003 Hoshi et al. ..... 430/270.1
2003/0166467 A1 * 9/2003 Azuma ..... 503/217

FOREIGN PATENT DOCUMENTS

JP 5-8537 1/1993
JP 8-118819 5/1996
JP 11-151856 6/1999
JP 2001-315367 11/2001
JP 2002-113889 4/2002

* cited by examiner

*Primary Examiner*—John R. Lee
*Assistant Examiner*—Bernard E. Souw
(74) *Attorney, Agent, or Firm*—Nixon & Vanderhye P.C.

(57) ABSTRACT

A reversible thermal recording material permits recording having a clear contrast at a high sensitivity and erasing such images a number of times, at least 1,000 times, repetitively, and comprises a leuco dye, a reversible developer and a light-heat-converting dye, the light-heat-converting dye having a deterioration ratio of 20% or less when a laser beam having an oscillation wavelength of 830 nm is applied thereto repeatedly 1000 times at a temperature of 25° C. at an energy of 2 J/cm$^2$ or being a phthalocyanine compound having a vanadyl group, and a method of recording an image comprises applying a laser beam to the reversible thermal recording material, wherein the colored leuco dye is achromatized with energy that is 25 to 65% of the energy of the laser beam employed for causing the leuco dye to develop a color.

10 Claims, No Drawings

REVERSIBLE THERMAL RECORDING MATERIAL AND METHOD OF RECORDING IMAGE ON REVERSIBLE THERMAL RECORDING MATERIAL

BACKGROUND OF THE INVENTION

1. Field of the Invention

The present invention relates to a reversible thermal recording material and a method of recording an image on the reversible thermal recording material. More specifically, the present invention relates to a reversible thermal recording material that repetitively permits stable recording and erasing of images having a clear contrast at high sensitivity, and a method of stably recording and erasing images repetitively by application of laser beam with a reversible thermal recording material capable of causing a reversible color tone change under the control of heat energy.

2. Explanation of Related Art

In recent years, a reversible thermal recording material is attracting attention, in which an image can be formed temporarily and when the image is no longer necessary, it can be erased. As the above reversible thermal recording material, for example, there have been proposed systems which are prepared by combining a leuco dye and a reversible developer with various light-heat converting materials and which perform recording with near infrared laser beam (JP-A-5-8537 and JP-A-11-151856).

In these systems, it is true that these systems can give a clear image contrast. However, none of these systems have proved formation and erasing of images at high sensitivity and repetitiveness of recording and erasing images 1,000 times or more, which are vital problems in practical application. When the present inventor has made duplicate tests of the above systems, systems using a deposition film of Cr, or the like as a light-heat converting material show low recording sensitivity since the systems cannot be selectively imparted with high absorbance depending upon the wavelength of a near infrared laser beam. For example, the thermal recording material described in JP-A-11-151856 cannot be said to be satisfactory in respect of recording sensitivity. In Examples of the above JP-A Publication, it is described that when a recorded image surface is observed after printing and erasing are repeated 100 times, the image-recorded surface is free of non-uniformity with regard to a recording state and an erasing state and is in a good condition. However, nothing is demonstrated with regard to repetitiveness of 1,000 times or more that is practically required, nor is it guaranteed.

Further, Example of JP-A-11-151856 describes an erasing method based on changing the intensity of laser beam from a laser recording machine. In printing, an image can be printed by applying energy to a desired portion alone. In erasing, however, it is required to apply energy to a large area as compared with the area of an image to be erased, so that the method of merely decreasing the intensity of beam takes a long erasing time period. Further, when the laser beam intensity is changeable for printing and erasing, the system comes to be complicated, and the time period for data processing required for printing and erasing an image comes to be longer, so that there is caused a problem that the erasing and printing come to take a very long time. Further, the above Publication has demonstrated nothing with regard to the applied energy of near infrared laser beam capable of repeating recording and erasing 1,000 times or more.

On the other hand, there is also proposed a method in which a laser beam is applied in a state where a light-heat-converting tape in the form of a cassette tape is in contact with an opaque type thermal recording medium, and printing and erasing are repeated while feeding the light-heat-converting tape (JP-A-2001-315367). In Examples of this laid-open publication, clear images are obtained even when printing and erasing are carried out 1,000 times. However, when the above light-heat-converting tape is used, it is required to exchange cassettes thereof like a cassette for an ink ribbon printer. Further, there is a problem that since the printing and erasing performances are greatly influenced by the state of a contact between the light-heat-converting tape and the surface of a thermal recording medium, they are greatly impaired by the surface roughness of the thermal recording medium and adherence of dust.

SUMMARY OF THE INVENTION

Under the circumstances, it is a first object of the present invention to provide a reversible thermal recording material that permits stably recording and erasing images having a clear contrast at high sensitivity a number of times, for example, at least 1,000 times repetitively.

It is another object of the present invention to provide a method of stably recording and erasing images a number of times, for example, at least 1,000 times repetitively with a reversible thermal recording material that causes a reversible color tone change under the control of heat energy by application of a laser beam.

For achieving the above objects, the present inventor has made diligent studies, and as a result, it has been found that the first object above can be achieved by a reversible thermal recording material which comprises a leuco dye, a reversible developer and a light-heat-converting dye, and which uses, as the light-heat-converting dye, (i) a dye whose deterioration ratio under a specific condition is a predetermined value or less or (ii) a phthalocyanine compound having a vanadyl group.

It has been further found that the second object above can be achieved by a method of recording an image on a reversible thermal recording material containing a leuco dye, a reversible developer and a light-heat-converting dye by heat generated by application of laser beam, wherein the energy of the laser beam is controlled to be in a specific range to achromatize the leuco dye that has formed a color.

The present invention has been completed on the basis of the above findings.

That is, the present invention provides (1) a reversible thermal recording material comprising a colorless or light-colored leuco dye, a reversible developer which causes said leuco dye to develop a color by heating and which achromatizes said leuco dye by re-heating, and a light-heat-converting dye, wherein said light-heat-converting dye has a deterioration ratio of 20% or less when a laser beam having an oscillation wavelength of 830 nm is applied thereto repeatedly 1000 times at a temperature of 25° C. at an energy of 2 J/cm$^2$ (to be referred to as "reversible thermal recording material I" hereinafter), (2) a reversible thermal recording material comprising a colorless or light-colored leuco dye, a reversible developer which causes said leuco dye to develop a color by heating and which achromatizes the leuco dye by re-heating, and a light-heat-converting dye, wherein the light-heat-converting dye is a phthalocyanine compound having a vanadyl group (to be referred to as "reversible thermal recording material II" hereinafter), and (3) a method of recording an image by applying a laser beam to a reversible thermal recording material comprising a colorless or light-colored leuco dye, a reversible developer which causes said leuco dye to develop a color by heating and which achromatizes the leuco dye by re-heating and a light-heat-converting dye, to record an image by heat generated by the application of the laser beam, wherein said leuco dye is achromatized with energy that is at least 25% but not more than 65% of the energy of the laser beam applied for causing said leuco dye to develop a color.

PREFERRED EMBODIMENTS OF THE INVENTION

The reversible thermal recording material of the present invention comprises a colorless or light-colored leuco dye, a reversible developer which causes said leuco dye to develop a color by heating and which achromatizes the leuco dye by re-heating, and a light-heat-converting dye. The reversible thermal recording material of the present invention includes two embodiments based on types of the above light-heat-converting dye used. The first embodiment is a reversible thermal recording material I that uses, as the above light-heat-converting dye, a light-heat-converting dye having a deterioration ratio of 20% or less when a laser beam having an oscillation wavelength of 830 nm is applied thereto at a temperature of 25° C. at an energy of 2 J/cm$^2$. The second embodiment is a reversible thermal recording material II that contains, as the above light-heat-converting dye, a phthalocyanine compound having a vanadyl group.

First, the reversible thermal recording material I as the first embodiment will be explained below.

A reversible thermal recording material which uses a light-heat-converting dye and permits recording and erasing images 1,000 times or more repetitively with a near infrared beam is required to have high heat resistance and high durability against laser beam. The present inventor has studied the heat resistance and the laser beam durability of a reversible thermal recording material, and it has been found that the laser beam durability of the light-heat-converting dye is an essential factor for recording and erasing that are carried out a number of times. When the light-heat-converting dye has poor laser beam durability, the dye deteriorates before the recording and erasing are carried out a number of times, the efficiency of conversion of laser beam to heat decreases, and the recording and erasing of images can be no longer carried out.

Conventionally, no light-heat-converting dye has been measured for such a property. The light resistance against sunlight and a fluorescence lamp is affected by a reaction between a dye in an excited state and triplet oxygen or by the generation of singlet oxygen and a reaction of the dye therewith, so that it is irrational to use data of the above light resistance as data for evaluating the laser durability. The present inventor has therefore measured light-heat-converting dyes for deterioration ratios (to be referred to as "deterioration ratio" hereinafter) by applying energy of 2 J/cm$^2$ 1,000 times repetitively under a temperature condition of 25° C. with a laser having an oscillation wavelength at 830 nm. As a result, it has been found that the deterioration ratio differs depending upon types of the light-heat-converting dyes, and that the object of the present invention can be achieved by selecting a light-heat-converting dye having a deterioration ratio of 20% or less.

With regard to the deterioration ratio, naturally, the lower the more advantageous. The deterioration ratio is preferably 15% or less, more preferably 10% or less, still more preferably 5% or less. When the deterioration ratio exceeds 20%, the color density decreases and the density of an erased portion increases gradually as the recording and erasing are repeated, so that the contrast of images decreases. It may be thinkable to employ a method in which a larger amount of a light-heat-converting dye having a high deterioration ratio is used in expectation of deterioration. However, the problem with this method is that a cost increases and that a reversible thermal recording material is colored due to an increase in absorption by the dye in visible light region. Further, there is another problem that the heat energy for recording and erasing comes to be excessive in an initial state, which accelerates the deterioration of the leuco dye, a binder, and the like.

Specifically, the method of measuring a dye for a deterioration ratio includes the preparation of a sample, the measurement of an absorbance, a deterioration test and the calculation of the deterioration ratio, and particulars of the measurement method will be explained below.

A sample for the measurement of the deterioration ratio is prepared by forming a film containing a light-heat-converting dye on a transparent substrate having no absorption in a near infrared region such as a polyethylene terephthalate (PET) sheet, or the like. The film containing a light-heat-converting dye contains, as a binder, a resin which has no absorption in the near infrared region and is stable against heat generated during the measurement. The amount of the light-heat-converting dye is not critical so long as it is measurable for an absorbance. However, the above amount is preferably an amount similar to that of the light-heat-converting dye to be incorporated into the reversible thermal recording material.

The measurement of an absorbance is conducted according to a transmission method, and an absorbance at 830 nm is determined.

The laser for use in the deterioration test is a semiconductor laser having an oscillation wavelength of 830 nm. The sample is placed under a temperature condition of 25° C., and a laser beam having energy of 2 J/cm$^2$ is applied 1,000 times repetitively.

The deterioration ratio is a value obtained by measuring a sample for an absorbance(Ab) before the deterioration test, measuring the sample for an absorbance(Aa) after the dete rioration test, dividing a value obtained by deducting Aa from Ab, by Ab, and multiplying the resultant value by 100.

$$\text{Deterioration Ratio}(\%) = \frac{Ab - Aa}{Ab} \times 100$$

In the present invention, the near infrared laser for use in recording and erasing images includes a semiconductor laser having a beam emission region at 740 to 910 nm and a YAG laser having a beam emission region at 900 to 1,200 nm, while the near infrared laser shall not be limited thereto. Naturally, the light-heat-converting dye is selected such that it has a sufficient light absorption coefficient at a wavelength of beam to be emitted from such a light source. In the present invention, the recording of images uses light from the above light source, and the images may be erased with a hot roll or a hot stamp that does not cause much thermal or mechanical damage on the recording material.

The light-heat-converting dye in the present invention has an absorption in a wavelength region of a laser beam used and is capable of converting the light to heat, and any light-heat-converting dye can be used without any special limitation so long as it has the above deterioration ratio. Specific examples of the light-heat-converting dye include a phthalocyanine compound, a metal complex compound, a polymethyne compound and a naphthoquinone compound, while the examples shall not be limited thereto. In view of the above deterioration ratio, the light-heat conversion efficiency, solubility in a solvent, dispersibility in a resin and light resistance to ultraviolet light, the light-heat-converting dye is preferably selected from a phthalocyanine compound or a metal complex compound, and a phthalocyanine compound is particularly preferred.

Examples of the phthalocyanine compound preferably include a naphthalocyanine compound, a metal-free phthalocyanine compound, an iron phthalocyanine compound, a copper phthalocyanine compound, a zinc phthalocyanine compound, a nickel phthalocyanine compound, a vanadyl phthalocyanine compound, an indium chloride phthalocyanine compound and a tin phthalocyanine compound. A vanadyl phthalocyanine compound, a zinc phthalocyanine compound and a tin phthalocyanine compound are more preferred. Of these, a vanadyl phthalocyanine compound having a vanadyl group, to be described later, is preferred. The phthalocyanine compound for use in the present invention may have a substituent on its aromatic ring for adjustment of the absorption wavelength, an improvement in solubility in a solvent and an improvement in light resistance. The substituent includes an alkyl ether group, an alkyl thioether group, an aryl ether group, an aryl thioether, an amide group, an amino group, an alkyl ester group, an aryl ester group, a chlorine atom and a fluorine atom. When two or more substituents are present on the aromatic ring, they may be the same or may be different, and they may bond each other and form a ring.

The amount of the light-heat-converting dye is preferably determined such that the absorbance at an oscillation wavelength of the light source used is at least 0.2. When the amount of the light-heat-converting dye is smaller than the above amount, no sufficient heat generation is obtained, and the recording sensitivity is low. The light-heat-converting dye has an absorption in a visible light region to some extent, and when the amount thereof is too large, the contrast is caused to decrease. The upper limit of the amount of the light-heat-converting dye is preferably determined so as to attain an average transmittance of at least 60% at 400 nm to 700 nm. Two or more light-heat-converting dyes may be used in combination. In this case, at least one of the light-heat-converting dyes has a deterioration ratio of 20% or less.

The reversible thermal recording material II will be explained hereinafter.

As explained with regard to the above reversible thermal recording material I, the durability of the light-heat-converting dye against laser beam is the most essential factor for recording and erasing that are carried out a number of times. The present inventor has therefore made diligent studies for a technique that makes it possible to record and erase images at least 1,000 times repetitively with a near infrared laser beam, and as a result, it has been found that the object of the present invention can be achieved by incorporating a phthalocyanine compound having a vanadyl group.

The phthalocyanine compound having a vanadyl group in the present invention includes naphthalocyanine. The phthalocyanine compound may have a substituent on an aromatic ring for adjustment of the absorption wavelength, an improvement in solubility in a solvent and an improvement in light resistance. The substituent includes an alkyl group, an acyl group, an acyloxy group, an aryl group, an alkylamino group, an arylamino group, an arylcarbonylamino group, an alkyl ether group, an alkyl thioether group, an aryl ether group, an aryl thioether group, an amide group, an amino group, an alkyl ester group, an aryl ester group, a chlorine atom, a fluorine atom, a cyano group, a nitro group, a sulfonyl group, a sulfonic acid group, a pyridyl group and an aminocarbonyl group. When two or more substituents are present on the aromatic ring, they may be the same or may be different, and they may bond each other and form a ring.

When the light-heat-converting dye is incorporated to a layer that contains the leuco dye and the reversible developer, desirably, it has solubility or dispersibility in an organic solvent, so that it is preferred to use a phthalocyanine compound having at least four substituents which may be the same as, or different from, one another and are selected from an alkyl group, an alkyl ether group, an alkyl thioether group, an aryl ether group or an aryl thioether group. The above alkyl group is preferably a linear or branched alkyl group having 4 to 12 carbon atoms. Further, an amide group, an amino group, a nitro group, a chlorine atom, a fluorine atom, etc., as substituents can serve to adjust the absorption wavelength and to improve light resistance.

Specific examples of the phthalocyanine compound having a vanadyl group include vanadyl phthalocyanine, vanadyl 2,9,16,23-tetra-tert-butyl-29H,31H-phthalocyanine, vanadyl 2,9,16,23-tetraacetyl-29H,31H-phthalocyanine, vanadyl 2,9,16,23-tetrachloro-29H,31H-phthalocyanine, vanadyl 2,9,16,23-tetrafluoro-29H,31H-phthalocyanine, vanadyl 2,9,16,23-tetranitro-29H,31H-phthalocyanine, vanadyl 2,9,16,23-tetraphenoxy-29H,31H-phthalocyanine, vanadyl 2,9,16,23-tetraphenoxycarbonyl-29H,31H-phthalocyanine, vanadyl 2,9,16,23-acetyloxy-29H,31H-phthalocyanine, vanadyl 2,9,16,23-acetylamino-29H,31H-phthalocyanine, vanadyl 2,9,16,23-tetraphenylthio-29H,31H-phthalocyanine, vanadyl 2,9,16,23-(4-pyridylmethoxy)-29H,31H-phthalocyanine, vanadyl 2,3,9,10,16,17,23,24-octakis(octyloxy)-29H,31H-phthalocyanine, vanadyl 2,11,20,29-tetra-tert-butyl-2,3-naphthalocyanine, vanadyl 3,10,17,24-tetra-tert-butyl-1,8,15,22-tetrakis(dimethylamino)-29H,31H-phthalocyanine, vanadyl 5,14,23,32-tetraphenyl-2,3-naphthalocyanine, vanadyl 5,9,14,18,23,27,32,36-octabutoxy-2,3-naphthalocyanine, vanadyl 5,9,14,18,23,27,32,36-octabutylthio-2,3-naphthalocyanine, tetrasodium vanadylphthalocyanine-tetrasulfonate and vanadyl tetrakis(4-cumylphenoxy)phthalocyanine, while the above phthalocyanine compound shall not be limited to these.

The light-heat-converting dye has an absorption in a visible light region to some extent, and when the amount thereof is too large, the contrast is caused to decrease. The amount of the light-heat-converting dye is preferably determined so as to attain an average transmittance of at least 60% at 400 nm to 700 nm. Two or more light-heat-converting dyes may be used in combination.

In the reversible thermal recording materials I and II of the present invention, the light-heat-converting dye is preferably contained in at least one layer of a layer containing the leuco dye and the reversible developer and a layer adjacent to the above layer. The light-heat-converting dye is more preferably contained in a layer containing the leuco dye and the reversible developer.

In the reversible thermal recording materials I and II of the present invention, specific examples of the leuco dye include the following dyes, while it shall not be limited thereto.

3-Diethylamino-7-o-chlorophenylaminofluorane, 3-diethylamino-7-m-chlorophenylaminofluorane, 3-diethylamino-7-p-chlorophenylaminofluorane, 3-diethylamino-7-o-fluorophenylaminofluorane, 3-diethylamino-7-m-fluorophenylaminofluorane, 3-diethylamino-7-p-fluorophenylaminofluorane, 3-di-n-butylamino-7-m-chlorophenylaminofluorane, 3-di-n-butylamino-7-p-chlorophenylaminofluorane, 3-di-n-butylamino-7-o-fluorophenylaminofluorane, 3-di-n-butylamino-7-m-fluorophenylaminofluorane, 3-di-n-butylamino-7-p-fluorophenylaminofluorane, 3-diethylamino-6-methyl-7-phenylaminofluorane, 3-diethylamino-6-methyl-7-o-chlorophenylaminofluorane, 3-diethylamino-6-methyl-7-m-chlorophenylaminofluorane, 3-diethylamino-6-methyl-7-p-chlorophenylaminofluorane, 3-diethylamino-6-methyl-7-o-fluorophenylaminofluorane, 3-diethylamino-6-methyl-7-o-tolylaminofluorane, 3-diethylamino-6-methyl-7-m-tolylaminofluorane, 3-diethylamino-6-methyl-7-p-tolylaminofluorane, 3-diethylamino-6-methyl-7-o-trifluoromethylphenylaminofluorane, 3-diethylamino-6-methyl-7-m-trifluoromethylphenylaminofluorane, 3-diethylamino-6-methyl-7-p-acetylphenylaminofluorane, 3-diethylamino-6-methoxy-7-phenylaminofluorane, 3-diethylamino-6-ethoxy-7-phenylaminofluorane, 3-di-n-butylamino-6-methyl-7-phenylaminofluorane, 3-di-n-butylamino-6-methyl-7-o-tolylaminofluorane, 3-di-n-butylamino-6-methyl-7-m-tolylaminofluorane, 3-di-n-butylamino-6-methyl-7-p-tolylaminofluorane, 3-di-n-butylamino-6-methyl-7-o-chlorophenylaminofluorane, 3-di-n-butylamino-6-methyl-7-m-chlorophenylaminofluorane, 3-di-n-butylamino-6-methyl-7-p-chlorophenylaminofluorane, 3-di-n-butylamino-6-methyl-7-o-fluorophenylaminofluorane, 3-di-n-butylamino-6-methyl-7-m-fluorophenylaminofluorane, 3-di-n-butylamino-6-methyl-7-p-fluorophenylaminofluorane, 3-di-n-butylamino-6-methyl-7-o-trifluoromethylphenylaminofluorane, 3-di-n-butylamino-6-methyl-7-m-trifluoromethylphenylaminofluorane, 3-di-n-butylamino-6-methyl-7-p-trifluoromethylphenylaminofluorane, 3-di-n-butylamino-6-methoxy-7-phenylaminofluorane, 3-di-n-butylamino-6-ethoxy-7-phenylaminofluorane, 3-di-n-pentylamino-6-methyl-7-phenylaminofluorane, 3-di-n-pentylamino-6-methyl-7-m-trifluoromethylphenylaminofluorane, 3-pyrrolidyl-6-methyl-7-phenylaminofluorane, 3-piperidyl-6-methyl-7-phenylaminofluorane, 3-N-methyl-N-isopentylamino-6-methyl-7-phenylaminofluorane, 3-N-methyl-N-cyclohexylamino-6-methyl-7-phenylaminofluorane, 3-N-methyl-N-n-butylamino-6-ethyl-7-phenylaminofluorane, 3-N-methyl-N-n-propylamino-6-methyl-7-phenylaminofluorane, 3-N-ethyl-N-isopentylamino-6-methyl-7-phenylaminofluorane, 3-N-ethyl-N-isopentylamino-6-methyl-7-o-chlorophenylaminofluorane, 3-N-ethyl-N-p-tolylamino-6-methyl-7-phenylaminofluorane, 3-N-ethyl-N-(4-ethoxybutyl)amino-6-methyl-7-phenylaminofluorane, 3-diethylamino-7-dibenzylaminofluorane, 3-diethylamino-7-octylaminofluorane, 3-diethylamino-7-phenylfluorane, 3-diethylamino-7-chlorofluorane, 3-diethylamino-6-chloro-7-methylfluorane, 3-diethylamino-7-(3,4-dichloroanilino)fluorane, 3-diethylamino-7-(2-chloroanilino)fluorane, 3,3-bis(p-dimethylaminophenyl)-6-dimethylaminophthalide (crystal violet lactone), 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, 3-p-dimethylaminophenyl-3-(1-methylpyrrol-2-yl)-6-dimethylaminophthalide, 3-(2-ethoxy-4-aminophenyl)-3-(1-ethyl-2-methylindol-3-yl)-4-azaphthalide, 3-(2-ethoxy-4-methylaminophenyl)-3-(1-ethyl-2-methylindol-3-yl)-4-azaphthalide, 3-(2-ethoxy-4-ethylaminophenyl)-3-(1-ethyl-2-methylindol-3-yl)-4-azaphthalide, 3-(2-ethoxy-4-propylaminophenyl)-3-(1-ethyl-2-methylindol-3-yl)-4-azaphthalide, 3-(2-ethoxy-4-hexylaminophenyl)-3-(1-ethyl-2-methylindol-3-yl)-4-azaphthalide, 3-(2-ethoxy-4-dimethylaminophenyl)-3-(1-ethyl-2-methylindol-3-yl)-4-azaphthalide, 3-(2-ethoxy-4-diethylaminophenyl)-3-(1-ethyl-2-methylindol-3-yl)-4-azaphthalide, 3-(2-ethoxy-4-dipropylaminophenyl)-3-(1-ethyl-2-methylindol-3-yl)-4-azaphthalide, 3-(2-ethoxy-4-dihexylaminophenyl)-3-(1-ethyl-2-methylindol-3-yl)-4-azaphthalide, 3-(2-ethoxy-4-phenylaminophenyl)-3-(1-ethyl-2-methylindol-3-yl)-4-azaphthalide, 3-(2-ethoxy-4-pyridylphenyl)-3-(1-ethyl-2-methylindol-3-yl)-4-azaphthalide, 3-(3-ethoxy-4-diethylaminophenyl)-3-(1-ethyl-2-methylindol-3-yl)-4-azaphthalide, 3-(2-methyl-4-diethylaminophenyl)-3-(1-ethyl-2-methylindol-3-yl)-4-azaphthalide, 3-(2-ethyl-4-diethylaminophenyl)-3-(1-ethyl-2-methylindol-3-yl)-4-azaphthalide, 3-(2-propyl-4-diethylaminophenyl)-3-(1-ethyl-2-methylindol-3-yl)-4-azaphthalide, 3-(2-butyl-4-diethylaminophenyl)-3-(1-ethyl-2-methylindol-3-yl)-4-azaphthalide, 3-(2-pentyl-4-diethylaminophenyl)-3-(1-ethyl-2-methylindol-3-yl)-4-azaphthalide, 3-(2-hexyl-4-diethylaminophenyl)-3-(1-ethyl-2-methylindol-3-yl)-4-azaphthalide, 3-(2-cyclohexyl-4-diethylaminophenyl)-3-(1-ethyl-2-methylindol-3-yl)-4-azaphthalide, 3-(2-cyano-4-diethylaminophenyl)-3-(1-ethyl-2-methylindol-3-yl)-4-azaphthalide, 3-(2-nitro-4-diethylaminophenyl)-3-(1-ethyl-2-methylindol-3-yl)-4-azaphthalide, 3-(2-chloro-4-diethylaminophenyl)-3-(1-ethyl-2-methylindol-3-yl)-4-azaphthalide, 3-(2-bromo-4-diethylaminophenyl)-3-(1-ethyl-2-methylindol-3-yl)-4-azaphthalide, 3-(2-methyl-4-diethylaminophenyl)-3-(1-fluoro-2-methylindol-3-yl)-4-azaphthalide, 3-(2-ethoxy-4-diethylaminophenyl)-3-(2-methylindol-3-yl)-4-azaphthalide, 3-(2-ethoxy-4-diethylaminophenyl)-3-(1-methyl-2-methylindol-3-yl)-4-azaphthalide, 3-(2-ethoxy-4-diethylaminophenyl)-3-(1-propyl-2-methylindol-3-yl)-4-azaphthalide, 3-(2-ethoxy-4-diethylaminophenyl)-3-(1-butyl-2-methylindol-3-yl)-4-azaphthalide, 3-(2-ethoxy-4-diethylaminophenyl)-3-(1-pentyl-2-methylindol-3-yl)-4-azaphthalide, 3-(2-ethoxy-4-diethylaminophenyl)-3-(1-hexyl-2-methylindol-3-yl)-4-azaphthalide, 3-(2-ethoxy-4-diethylaminophenyl)-3-(1-heptyl-2-methylindol-3-yl)-4-azaphthalide, 3-(2-ethoxy-4-diethylaminophenyl)-3-(1-octyl-2-methylindol-3-yl)-4-azaphthalide, 3-(2-ethoxy-4-diethylaminophenyl)-3-(1-nonyl-2-methylindol-3-yl)-4-azaphthalide, 3-(2-ethoxy-4-diethylaminophenyl)-3-(1-isopropyl-2-methylindol-3-yl)-4-azaphthalide, 3-(2-ethoxy-4-diethylaminophenyl)-3-(1-isobutyl-2-methylindol-3-yl)-4-azaphthalide, 3-(2-ethoxy-4-diethylaminophenyl)-3-(1-isopentyl-2-methylindol-3-yl)-4-azaphthalide, 3-(2-ethoxy-4-diethylaminophenyl)-3-(1-methyl-2-ethylindol-3-yl)-4-azaphthalide, 3-(2-ethoxy-4-diethylaminophenyl)-3-(1-ethyl-2-propylindol-3-yl)-4-azaphthalide, 3-(2-ethoxy-4-diethylaminophenyl)-3-(1-ethyl-2-butylindol-3-yl)-4-azaphthalide, 3-(2-ethoxy-4-diethylaminophenyl)-3-(1-ethyl-2-pentylindol-3-yl)-4-azaphthalide, 3-(2-ethoxy-4-diethylaminophenyl)-3-(1-ethyl-2-hexylindol-3-yl)-4-azaphthalide, 3-(2-ethoxy-4-diethylaminophenyl)-3-(1-ethyl-2-isopropylindol-3-yl)-4-azaphthalide, 3-(2-ethoxy-4-diethylaminophenyl)-3-(1-ethyl-2-isobutylindol-3-yl)-4-azaphthalide, 3-(2-ethoxy-4-diethylaminophenyl)-3-(1-ethyl-2-phenylindol-3-yl)-4-azaphthalide, 4,4'-bis(dimethylaminophenyl)benzhydrylbenzyl ether, N-chlorophenyl leucoauramine, N-2,4,5-trichlorophenyl leucoauramine, benzoyl leucomethylene blue, p-nitrobenzoyl leucomethylene blue, 3-methylspirodinaphthopyran, 3-ethylspirodinaphthopyran, 3,3'-dichloropirodinaphthopyran, 3-benzylspirodinaphthopyran, 3-methylnaphtho-(3-methoxybenzo)spiropyran, and 3-propylspirobenzopyran.

The above leuco dyes may be used alone or in combination. Further, a leuco dye that forms a color of other hue may be mixed with the above leuco dye to adjust the color tone.

In the reversible thermal recording materials I and II, the reversible developer is preferably a compound having the following general formula (1), while the reversible developer shall not be limited thereto.

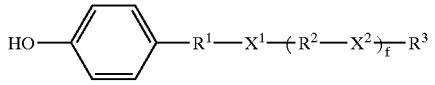

(1)

In the compound of the general formula (1), each of $X^1$ and $X^2$ is independently an oxygen atom, a sulfur atom or a divalent group having a —CONH— bond as a minimum constituent unit and containing no hydrocarbon groups on two terminals. $R^1$ is a single bond or a divalent hydrocarbon group having 1 to 12 carbon atoms. $R^2$ is a divalent hydrocarbon group having 1 to 18 carbon atoms, preferably a divalent hydrocarbon group having 1 to 4 carbon atoms. $R^3$ is a monovalent hydrocarbon group having 1 to 24 carbon atoms, preferably a hydrocarbon group having 6 to 24 carbon atoms, more preferably a hydrocarbon group having 8 to 24 carbon atoms. Further, particularly preferably, the total sum of numbers of carbons of $R^1$, $R^2$ and $R^3$ is at least 11 but not more than 35. Each of $R^1$, $R^2$ and $R^3$ mainly represents an alkylene group or an alkyl group. $R^1$ may represent an aromatic ring. f is an integer of 0 to 4, and when f is 2 or more, repeating units of $R^2$ and $X^2$ may be the same or different.

In the general formula (1), the definition of each of $X^1$ and $X^2$ includes a divalent group having a —CONH— bond as a minimum constituent unit and containing no hydrocarbon atomic groups on two terminals. Specific examples of the above divalent group include diacylamine (—CONHCO—), diacylhydrazine (—CONHNHCO—), oxalic acid diamide (—NHCOCONH—), acylurea (—CONHCONH—, —NHCONHCO—), semicarbazide (—NHCONHNH—, —NHNHCONH—), acylsemicarbazide (—CONHNHCONH—, —NHCONHNHCO—), diacylaminomethane (—$CONHCH_2NHCO$—), 1-acylamino-1-ureidomethane (—$CONHCH_2NHCONH$—, —$NHCONHCH_2NHCO$—), malonamide (—$NHCOCH_2CONH$—) and 3-acylcarbazinic ester (—CONHNHCOO—, —OCONHNHCO—). Preferred are diacylhydrazine, oxalic acid diamide and acylsemicarbazide.

Specific examples of the reversible developer for use in the present invention include developers having the following structural formulae, while the reversible developer shall not be limited thereto.

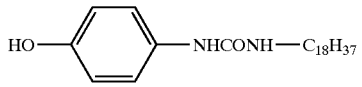

(1-1)

-continued (1-2)

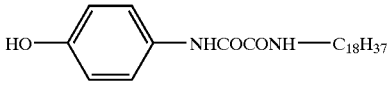

(1-3)

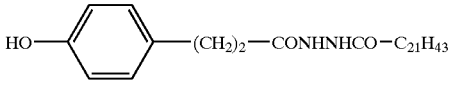

(1-4)

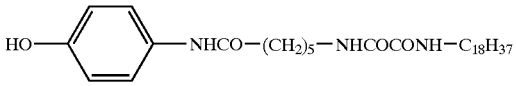

(1-5)

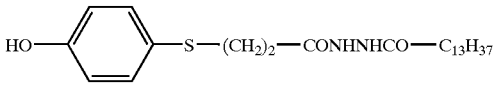

(1-6)

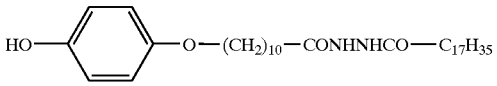

(1-7)

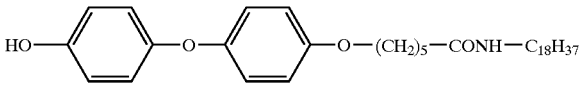

(1-8)

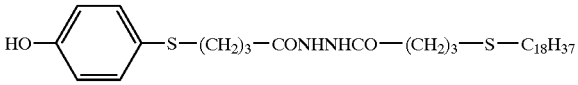

(1-9)

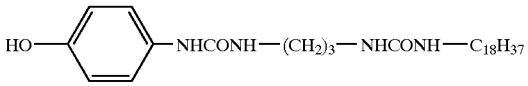

(1-10)

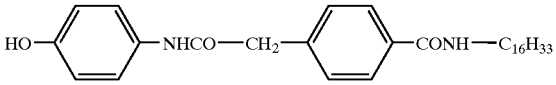

(1-11)

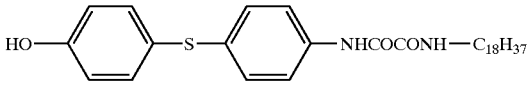

(1-12)

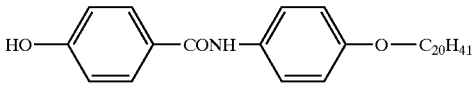

(1-13)

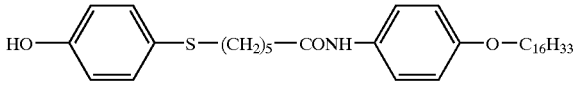

(1-14)

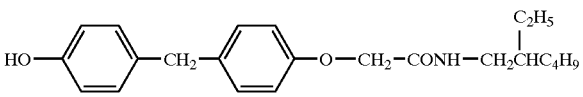

(1-15)

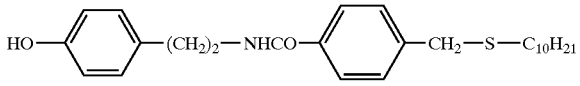

-continued (1-16)

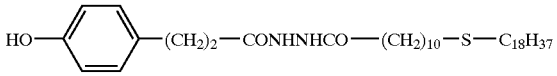

The above reversible developers may be used alone or in combination. The amount of the reversible developer based on the colorless or light-colored leuco dye is 5 to 5,000 mass %, preferably 10 to 3,000 mass %.

The method for the production of the reversible thermal recording materials I and II of the present invention will be explained hereinafter, while the present invention shall not be limited thereto.

The method for producing the reversible thermal recording materials I and II of the present invention is specifically a method in which the colorless or light-colored leuco dye, the reversible developer and the light-heat-converting dye are used as main components, and these components are applied or printed on a substrate to form a reversible thermal recording layer.

The method for incorporating the colorless or light-colored leuco dye, the reversible developer and the light-heat-converting dye into the reversible thermal recording layer includes a method in which a mixture is prepared by dissolving the above components separately in solvents or dispersing the above components in dispersing media and mixing the resultant solutions or dispersion, by mixing the above components and then dissolving the mixture in a solvent or dispersing the mixture in a dispersing medium, or by melting the above components under heat to form a uniform melt, then, cooling the melt and dissolving the melt in a solvent or dispersing it in a dispersing medium, and the mixture is applied onto a substrate or printed on a substrate, and the applied or printed mixture is dried to form a layer.

When the light-heat-converting dye is incorporated into a layer different from a layer containing the leuco dye and the reversible developer, preferably, the light-heat-converting dye is dispersed alone or together with a binder and a layer adjacent to a layer containing the reversible developer is allowed to contain the light-heat-converting dye.

For improving the reversible thermal recording layer in strength, the reversible thermal recording layer may contain a binder. Specific examples of the binder include starches, hydroxyethyl cellulose, methyl cellulose, carboxymethyl cellulose, gelatin, casein, polyvinyl alcohol, modified polyvinyl alcohol, sodium polyacrylate, an acrylamide/acrylic ester copolymer, an acrylamide/acrylic ester/methacrylate terpolymer, an alkali salt of a styrene/maleic anhydride copolymer, an alkali salt of an ethylene/maleic anhydride copolymer, polyvinyl acetate, polyurethane, polyacrylic ester, a styrene/butadiene copolymer, an acrylonitrile/butadiene copolymer, a methyl acrylate/butadiene copolymer, an ethylene/vinyl acetate copolymer, an ethylene/vinyl chloride copolymer, polyvinyl chloride, an ethylene/vinylidene chloride copolymer, polyvinylidene chloride, polycarbonate and polyvinyl butyral. These binders work to keep the components of a composition in a state where the components are uniformly dispersed without being unevenly distributed under application of heat for printing and erasing. As a binder, therefore, it is preferred to use a resin having high heat resistance. Reversible thermal recording materials having high value added such as a prepaid card or a store card are recently increasingly used, and there are demanded products having high durability including as heat resistance and water resistance and further including adhesion. For such demands, a curable resin is particularly preferred.

The curable resin includes, for example, a thermosetting resin, an electron beam curable resin, an ultraviolet ray curable resin and the like. The thermosetting resin includes resins that are cured by a reaction between a hydroxyl group or a carboxyl group thereof with a crosslinking agent, such as a phenoxy resin, a polyvinyl butyral resin and a cellulose acetate propionate resin. The above crosslinking agent is selected from isocyanates, amines, phenols and epoxys.

The monomer for electron beam and ultraviolet ray curable resins includes a monofunctional monomer, a difunctional monomer and a polyfunctional monomer typified by acrylic monomers. Particularly for crosslinking with ultraviolet ray, a photopolymerization initiator and a photopolymerization promoter are used.

For preventing the aging of the reversible thermal recording material, an aging preventer used for a rubber product, etc., may be added. The aging preventer may be incorporated to a layer positioned above or below the reversible thermal recording layer. For preventing the deterioration caused on the light-heat-converting dye by ultraviolet ray, an aging preventer may be incorporated into a layer containing the light-heat-converting dye or a layer positioned above the layer containing the light-heat-converting dye. The aging preventer includes amine compounds such as p,p'-diaminodiphenylmethane, aldol-α-naphthylamine and N,N'-diphenyl-p-phenylenediamine, phenol compounds such as hydroxymonobenzyl ether and 1,1-bis(p-hydroxyphenyl) cyclohexane, a benzotriazole compound, a triazine compound, a benzophenone compound and a benzoate compound. Besides these, the aging preventer also includes o-phenylenethiourea, a zinc salt of 2-aminobenzoimidazole, nickel dibutylthiocarbamate, zinc oxide and a paraffin. There may be also used a polymer containing, as a component, a monomer having the above aging preventer structure or a polymer unit having a main polymer chain to which the above aging preventer structure is grafted. Two or more aging preventers may be used in combination.

As an additive for adjusting the color-developing sensitivity and achromatizing temperature, the reversible thermal recording layer may contain a heat-fusible substance. The heat-fusible substance preferably has a melting point of 60 to 200° C., particularly preferably 80 to 180° C. There may be also used a sensitizer that is used for general thermal recording papers. Examples of the heat-fusible substance include waxes such as N-hydroxymethylstearamide, stearamide and palmitamide, naphthol derivatives such as 2-benzyloxynaphthalene, biphenyl derivatives such as p-benzylbiphenyl and 4-alkyloxybiphenyl, polyether compounds such as 1,2-bis(3-methylphenoxy)ethane, 2,2'-bis(4-methoxyphenoxy)diethyl ether and bis(4-methoxyphenyl) ether, and carbonic or oxalic dieters such as diphenyl carbonate, dibenzyl oxalate and oxalic bis(p-methylbenzyl) ester. These may be used in combination.

The substrate for use in the reversible thermal recording materials I and II of the present invention can be selected from paper, various non-woven fabrics, woven fabrics, a synthetic resin film, a synthetic resin laminated paper, a synthetic paper, a metal foil, glass or a composite sheet combining at least two members of these as required. The substrate may be transparent, semi-transparent or non-transparent. Further, the substrate shall not be limited to these.

In the layer constitution of the reversible thermal recording materials I and II of the present invention, a protective layer and an intermediate layer may be formed on or under the reversible thermal recording layer. In this case, the protective layer and the -intermediate layer may be formed of a plurality of layers such as two layers or three or more layers. Further, the reversible thermal recording layer or other layer may contain a material that permits electrical, magnetic or optical recording of information, and such a material may be present in a surface where the reversible thermal recording layer is formed or in a surface opposite to the surface where the reversible thermal recording layer is formed. A back coating layer for preventing a curling and static electrification may be formed on a surface opposite to the surface where the reversible thermal recording layer is formed.

Further, the reversible thermal recording layer, the protective layer and the intermediate layer may contain a pigment such as diatomaceous earth, talc, kaolin, calcined kaolin, calcium carbonate, magnesium carbonate, titanium oxide, zinc oxide, silicon oxide, aluminum hydroxide or a urea-formalin resin, a higher fatty acid metal salt such as zinc stearate or calcium stearate, a wax such as paraffin, paraffin oxide, polyethylene, polyethylene oxide, stearmide or castor wax, a dispersing agent such as sodium dioctyl sulfosuccinate, a surfactant and a fluorescent dye.

The method of recording an image in the present invention will be explained hereinafter.

The method of recording an image in the present invention refers to a method of recording an image by applying a laser beam to a reversible thermal recording material comprising a colorless or light-colored leuco dye, a reversible developer which causes said leuco dye to develop a color by heating and which achromatizes the leuco dye by re-heating, and a light-heat-converting dye, to record an image by heat generated by the application of the laser beam, wherein said leuco dye is achromatized with energy that is at least 25% but not more than 65% of the energy of the laser beam applied for causing said leuco dye to develop a color.

The reversible thermal recording material using the light-heat-converting dye for recording and erasing images at least 1,000 times repetitively with a near infrared beam is naturally required to have high heat resistance and laser beam durability, and it is more important to carry out the recording and erasing by a method that does not cause much load on the reversible thermal recording material. As the above reversible thermal recording material, the reversible thermal recording material (I) and (II) of the present invention is preferred. The present inventor has made diligent studies for a method in which images can be recorded and erased repetitively on the reversible thermal recording material of the present invention without any contact thereto. As a result, it has been found that images having a clear contrast can be recorded and erased a number of times, 1,000 times or more, repetitively, regardless of the amount of the light-heat-converting dye contained, by erasing images by applying a laser beam with energy that is at least 25% but not more than 65% of the laser energy applied for sufficient color development and for making it possible to cause the leuco dye to develop a color without causing abrasion or blister. The erasing energy is more preferably at least 30% but not more than 50% of the laser energy applied for sufficient color development and for making it possible to cause the leuco dye to develop a color without causing abrasion or blister. When the energy in the above range is employed, images can be recorded and erased 2,000 times or more.

The method of changing the applied energy of a laser beam to be used for recording and erasing includes a method in which the application time period of a laser beam is changed while maintaining the output of the laser at a constant level, a method in which the output of the laser is changed, a method in which the focus of the laser is shifted, and a method in which a filter is used, and one of these methods is employed so that the leaser energy that reaches a recording surface is changed. According to studies made by the present inventor, it is preferred to use a method in which the application time period of a laser beam is changed while maintaining the output of the laser at a constant level, so that the leaser energy that reaches a recording surface is changed, since recording and erasing of images that are carried out a number of times can be realized at a high level. When the laser output is maintained at a constant level, the laser application time period for erasing is set in the range that is at least 25% but nor more than 65% of the laser beam application time period required for causing the leuco dye to develop a color, whereby the energy to applied to a unit area can be set in the range that is at least 25% but nor more than 65% of the energy of the laser beam applied for causing the leuco dye to develop a color. The laser beam application time period is decreased without decreasing the laser output, so that rapid erasing can be carried out.

The method in which laser beam application time period is changed includes a method in which the scanning rate of the laser beam is changed. When the laser output is constant, the scanning rate is set so that it is at least 1.6 times but not more than 4 times the laser beam scanning rate required for causing the leuco dye to develop a color, whereby the laser beam application time period can be set so that it is at least 25% but not more than 65%.

In a method of erasing an image with a pulse laser, the laser output and the number of spots in a unit area are set at constant levels, the time period for applying laser beam to one spot (pulse width) is changed, whereby the laser beam application time period in a unit area can be adjusted. The pulse width for erasing is set so that it is at least 25% but not more than 65% of the pulse width required for causing the leuco dye to develop a color, whereby the laser beam application time period can be set so that it is at least 25% but not more than 65%.

Further, the laser output and the pulse width are set at constant levels and the number of spots of the laser beam is decreased, whereby the laser application time period in a unit area can be decreased. In this case, the number of spots is set such that it is at least 25% but not more than 65% of the number of spots required for causing the leuco dye to develop a color, whereby the laser beam application time period can be set so that it is at least 25% but not more than 65%. As a method of changing the number of spots, there is employed a method in which the laser beam is applied to spots at intervals of several spots, a method in which the laser beam is applied to spots at intervals of several rows or a combination of these methods, whereby the number of spots of the laser beam applied per unit area can be changed. For decreasing non-uniformity in erasing images, it is preferred to apply the laser beam according to a regular pattern.

As a method of adjusting the laser beam application time period, the above methods may be combined. For example, the pulse width for erasing is set such that it is 50% of the pulse width for forming an image, and the number of spots is set such that it is 50% of the number of spots for forming an image, whereby the erasing energy can be set so that it is 25% of the laser energy applied for forming an image.

In the method of recording an image in the present invention, examples of the near infrared laser for use in recording and erasing images preferably include a semiconductor laser having a beam emission region at 740 to 910 nm and a YAG laser having a beam emission region at 900 to 1,500 nm. For erasing an image, a laser beam is applied to the color-developed leuco dye, it is preferred to use a laser beam having a wavelength of 800 nm or greater for decreasing the deterioration of the leuco dye. Further, most of dyes can stably and efficiently convert laser beam to heat at 1,200 nm or shorter, so that it is further preferred to apply a laser beam having a wavelength of at least 800 nm but not more than 1,200 nm.

According to the present invention, there can be provided a reversible thermal recording material that permits stable recording and erasing images having a clear contrast at high sensitivity a number of times, for example, at least 1,000 times repetitively. According to the method of recording an image in the present invention, there is used a reversible thermal recording material capable of causing a reversible color tone change by controlling the heat energy, and recording and erasing can be stably carried out a number of times, for example, at least 1,000 times repetitively by application of a laser beam.

The present invention will be explained more in detail with reference to Examples hereinafter, while the present invention shall not be limited by these Examples. In Examples, "part" and "percentage" are based on a mass.

EXAMPLE 1

[Measurement of Deterioration Ratio]

3 Parts of a light-heat-converting dye (YKR5010, supplied by YAMAMOTO CHEMICAL INC.), 80 parts of polyester polyol (BURNOCK D-293-70, supplied by Dainippon Ink and Chemicals, Incorporated), 110 parts of a curing agent (CORONATE HL, supplied by NIPPON POLYURETHANE INDUSTRY CO., LTD.), 300 parts of methyl ethyl ketone and 300 parts of toluene were mixed together with glass beads with a paint conditioner for 2 hours, and the mixture was applied onto a transparent polyethylene terephthalate (PET) sheet so as to form a coating having a dry weight of 2 g/m$^2$. The applied mixture was dried to give a sample for measurement of a deterioration ratio.

The above sample was measured for a transmittance spectrum, and an absorbance (A-1) at 830 nm was determined. Then, a laser beam was applied to the sample in a region having sides having a length of approximately 4 cm each at application energy of 2 J/cm$^2$ from a semiconductor laser having a wavelength of 830 nm. The above laser beam application procedure was repeated 1,000 times repetitively. Then, the applied portion was measured for a transmittance spectrum, and an absorbance (A-2) at 830 nm was determined. A value obtained by deducting A-2 from A-1 was divided by A-1, and an obtained value was multiplied by 100, to give 3%.

[Preparation of Reversible Thermal Recording Material]

20 Parts of 3-diethylamino-6-methyl-7-m-trifluoromethylphenylaminofluorane (BLACK 100, supplied by YAMADA CHEMICAL CO.) as a leuco dye, 100 parts of N-[3-(p-hydroxyphenyl)propiono]-N'-n-docosahydrazide as a reversible developer, 50 parts of polyester polyol (BURNOCK D-293-70, supplied by Dainippon Ink and Chemicals, Incorporated), 50 parts of a curing agent (CORONATE HL, supplied by NIPPON POLYURETHANE INDUSTRY CO., LTD.), 300 parts of methyl ethyl ketone, 300 parts of toluene, and 1 part of a light-heat-converting dye (YKR5010, supplied by YAMAMOTO CHEMICAL, INC.) were pulverized together with glass beads with a paint conditioner for 5 hours, to give a dispersion. The above dispersion was applied onto a PET sheet so as to form a coating having a solid content of 7 g/m$^2$, to give a reversible thermal recording material.

[Printing and Erasing Test]

The above-obtained reversible thermal recording material was caused to develop a color with application energy of 2 J/cm$^2$ with a semiconductor laser having a wavelength of 830 nm under a temperature condition of 25±1° C., and a colored portion was measured for a density with a Macbeth RD918. Then, energy of 1 J/cm$^2$ was applied to achromatize the developed color, and an achromatized portion was measured for a density with a Macbeth RD918. The difference between the density of the developed color and the density of the achromatized portion (to be referred to as "first contrast") was 0.65. The color development and the achromatization were repeated in the same manner as above, and such contrasts after the color development (printing) and the achromatization were repeated 200 times (200th contrast) and 1,000 times (1,000th contrast) were determined, to show 0.64 and 0.63.

EXAMPLES 2–3 AND COMPARATIVE EXAMPLES 1–3

Reversible thermal recording materials were prepared in the same manner as in Example 1 except that the light-heat-converting dye was replaced with those shown in Table 1. Each of these reversible thermal recording materials was measured for a deterioration ratio, and contrasts were determined after the color development and the achromatization were carried out once and after they were repeated 200 times and 1,000 times. Concerning values of the contrast, ◎ shows a contrast of 0.6 or more, ○ shows a contrast of at least 0.4 but less than 0.6, Δ shows a contrast of at least 0.3 but less than 0.4, and × shows a contrast of less than 0.3. Table 1 shows the results together with the results obtained in Example 1.

TABLE 1

| | Light-heat-converting dye | DR (%) | Contrast First | Contrast 200th | Contrast 1000th |
|---|---|---|---|---|---|
| Ex. 1 | YKR5010, YAMAMOTO CHEMICAL INC. | 3 | ◎ | ◎ | ◎ |
| Ex. 2 | YKR3080, YAMAMOTO CHEMICAL INC. | 6 | ◎ | ◎ | ○ |
| Ex. 3 | YKR3070, YAMAMOTO CHEMICAL INC. | 15 | ◎ | ○ | ○ |
| CEx. 1 | EXCOLOR TX-EX-805K, Nippon Shokubai Co., Ltd. | 30 | ◎ | Δ | X |
| CEx. 2 | EXCOLOR TX-EX-903B, Nippon Shokubai Co., Ltd. | 45 | ○ | Δ | X |
| CEx. 3 | YKR2900, YAMAMOTO CHEMICAL INC. | 89 | ○ | X | X |

Ex. = Example,
CEx. = Comparative Example,
DR = Deterioration ratio
◎: at least 0.6,
○: at least 0.4 but less than 0.6,
Δ: at least 0.3 but less than 0.4,
X: less than 0.3

As clearly shown in Table 1, samples in Examples in which the deterioration was less than 20% gave a clear contrast even after the printing and the achromatization were repeated 1,000 times.

EXAMPLES 4–10

Reversible thermal recording materials were obtained in the same manner as in Example 1 except that the light-heat-converting dye was replaced with vanadyl 2,11,20,29-tetra-tert-butyl-2,3-naphthalocyanine, vanadyl 3,10,17,24-tert-butyl-1,8,15,22-tetrakis(dimethylamino)-29H,31H-phthalocyanine, vanadyl 2,9,16,23-tetraphenoxy-29H,31H-phthalocyanine, vanadyl 5,14,23,32-tetraphenyl-2,3-naphthalocyanine, vanadyl 5,9,14,18,23,27,32,36-octabutoxy-2,3-naphthalocyanine, vanadyl 2,11,20,29-tetra-tert-amylthio-2,3-naphthalocyanine and vanadyl 2,11,20,29-tetranitro-5,9,14,18,23,27,32,36-octabutoxy-2,3-naphthalocyanine.

COMPARATIVE EXAMPLES 4–8

Reversible thermal recording materials were obtained in the same manner as in Example 1 except that the light-heat-converting dye was replaced with tin (II) 2,3-naphthalocyanine dichloride, silicon 2,3-naphthalocyanine-bis(trihexylsiloxide), silicon 2,3-naphthalocyanine-di-octyl oxide, zinc 2,11,20,29-tetra-tert-butyl-2,3-naphthalocyanine and cobalt 2,11,20,29-tetra-tert-butyl-2,3-naphthalocyanine.

[Evaluations]

With regard to the reversible thermal recording materials obtained in Examples 4 to 10 and Comparative Examples 4 to 8, a difference between the density of a colored portion and an achromatized portion (to be referred to as "first contrast" hereinafter) was determined in the same manner as in Example 1. Further, the color development and the achromatization were repeated in the same manner as above, and such contrasts after the color development (printing) and the achromatization were repeated 500 times (500th contrast), 1,000 times (1,000th contrast) and 2,000 times (2,000th contrast) were determined. The contrasts were evaluated on the basis of the same evaluation standard as that in Example 1. Further, achromatized portions were visually evaluated. "A" shows complete erasing, "B" shows incomplete erasing of an image, and "C" shows fogging caused by erasing. Table 2 shows the results.

TABLE 2

| | First | | 500th | | 1,000th | | 2,000th | |
|---|---|---|---|---|---|---|---|---|
| | Ac.p | Con. | Ac.p | Con. | Ac.p | Con. | Ac.p | Con. |
| Ex. 4 | A | ◎ | A | ◎ | A | ◎ | A | ◎ |
| Ex. 5 | A | ◎ | A | ◎ | A | ◎ | A | ◎ |
| Ex. 6 | A | ○ | A | ○ | A | ○ | A | ○ |
| Ex. 7 | A | ◎ | A | ◎ | A | ◎ | A | ◎ |
| Ex. 8 | A | ◎ | A | ◎ | A | ◎ | A | ◎ |
| Ex. 9 | A | ◎ | A | ◎ | A | ◎ | A | ◎ |
| Ex. 10 | A | ◎ | A | ◎ | A | ◎ | A | ◎ |
| CEx. 4 | A | ○ | C | Δ | C | Δ | C | X |
| CEx. 5 | B | Δ | B | X | B | X | B | X |
| CEx. 6 | B | Δ | B | X | B | X | B | X |
| CEx. 7 | A | ○ | B | Δ | B | X | B | X |
| CEx. 8 | A | ○ | B | Δ | B | Δ | B | X |

Ex. = Example,
CEx. = Comparative Example
(Ac.p = Achromatized portion)
A: Complete erasing,
B: Incomplete erasing of an image,
C: Fogging caused by erasing
(Con. = Contrast)
◎: at least 0.6,
○: at least 0.4 but less than 0.6,
Δ: at least 0.3 but less than 0.4,
X: less than 0.3

EXAMPLE 11

A reversible thermal recording material was obtained in the same manner as in Example 1 except that the light-heat-converting dye was replaced with TX-EX-814 (supplied by Nippon Shokubai Co., Ltd.).

An image was formed on the above reversible thermal recording material with a continuous-wave semiconductor laser having an oscillation wavelength of 830 nm and an output of 1 W under application conditions of a 50 $\mu$m spot diameter and a 100 cm/second scanning rate, and a colored portion was measured for a density with a Macbeth RD918. Then, a laser was applied under a condition where the scanning rate was set at 200 cm/second, to erase the image. An erased portion was measured for a density with a Macbeth RD918, and the erased (achromatized) portion was visually observed for incomplete erasing or fogging and evaluated on the same standard as that employed in Examples 4 to 10. Further, a difference between the density of a colored portion and an achromatized portion (to be referred to as "first contrast" hereinafter) was determined in the same manner as in Example 1. Further, the color development and the achromatization were repeated in the same manner as above, and such contrasts after the color development (printing) and the achromatization were repeated 500 times (500th contrast), 1,000 times (1,000th contrast) and 2,000 times (2,000th contrast) were determined. The contrasts were evaluated on the basis of the same evaluation standard as that in Example 1. Table 3 shows the results.

EXAMPLES 12–14

An experiment was carried out in the same manner as in Example 11 except that the scanning rate of the semiconductor laser for erasing was changed to 222 cm/second, 250 cm/second and 333 cm/second.

EXAMPLES 15 and 16

An experiment was carried out in the same manner as in Example 11 except that the scanning rate of the semiconductor laser for forming an image was changed to 118 cm/second and that the scanning rate of the semiconductor laser for erasing was changed to 183 cm/second and 200 cm/second.

COMPARATIVE EXAMPLE 9

An experiment was carried out in the same manner as in Example 11 except that the scanning rate of the semiconductor laser for forming an image was changed to 118 cm/second and that the scanning rate of the semiconductor laser for erasing was changed to 167 cm/second.

EXAMPLE 17

An experiment was carried out in the same manner as in Example 11 except that the scanning rate of the semiconductor laser for forming an image was changed to 83 cm/second and that the scanning rate of the semiconductor laser for erasing was changed to 332 cm/second.

COMPARATIVE EXAMPLE 10

An experiment was carried out in the same manner as in Example 11 except that the scanning rate of the semiconductor laser for forming an image was changed to 83 cm/second and that the scanning rate of the semiconductor laser for erasing was changed to 400 cm/second.

[Evaluations]

In Examples 12 to 17 and Comparative Examples 9 and 10, the color development and the achromatization were repeated in the same manner as in Example 11, and the reversible thermal recording materials were evaluated in the same manner as in Example 11. Table 3 shows the results together with the results of the reversible thermal recording material in Example 11. In Table 3, ROR stands for "ratio of rates (times)" that shows a ratio of the scanning rate of the semiconductor laser for erasing/the scanning rate of the semiconductor laser for forming an image.

TABLE 3

| | | First | | 500th | | 1,000th | | 2,000th | |
|---|---|---|---|---|---|---|---|---|---|
| | ROR | Ac.p | Con. | Ac.p | Con. | Ac.p | Con. | Ac.p | Con. |
| Ex. 11 | 2.0 | A | ◎ | A | ◎ | A | ◎ | A | ◎ |
| Ex. 12 | 2.2 | A | ◎ | A | ◎ | A | ◎ | A | ◎ |
| Ex. 13 | 2.5 | A | ◎ | A | ◎ | A | ◎ | A | ◎ |
| Ex. 14 | 3.3 | A | ◎ | A | ◎ | A | ◎ | A | ◎ |
| Ex. 15 | 1.6 | A | ◎ | A | ◎ | A | ○ | C | ○ |
| Ex. 16 | 1.7 | A | ◎ | A | ◎ | A | ○ | C | ○ |
| Ex. 17 | 4.0 | A | ◎ | A | ◎ | A | ○ | B | ○ |

TABLE 3-continued

| | ROR | First | | 500th | | 1,000th | | 2,000th | |
|---|---|---|---|---|---|---|---|---|---|
| | | Ac.p | Con. | Ac.p | Con. | Ac.p | Con. | Ac.p | Con. |
| CEx. 9 | 1.4 | A | ⊙ | C | ○ | C | Δ | C | X |
| CEx. 10 | 4.8 | A | ⊙ | B | ⊙ | B | ○ | B | Δ |

ROR = Ratio of rates (times)
Ex. = Example,
CEx. = Comparative Example
(Ac.p = Achromatized portion)
A: Complete erasing,
B: Incomplete erasing of an image,
C: Fogging
(Con. = Contrast)
⊙: at least 0.6,
○: at least 0.4 but less than 0.6,
Δ: at least 0.3 but less than 0.4,
X: less than 0.3

As clearly shown in the results in Table 3, images were completely erased in Examples 11 to 17 after the color development and the achromatization were carried out 1,000 times repetitively, and clear contrasts were obtained. Especially in Examples 11–14, complete erasing was achieved after the color development and the achromatization were carried out 2000 times repetitively, and clear contrasts were obtained.

EXAMPLES 18–24 AND COMPARATIVE EXAMPLES 11 AND 12

The pulse width for forming an image was set at 63.5 μsecond, and the ratio (%) of the pulse width for erasing to the pulse width for forming an iamge was set as shown in Table 4. Images were formed and erased with a pulse laser beam. The laser output and the spot diameter in experiments were the same as those in Example 11. Table 4 shows the results.

TABLE 4

| | Pulse width | First | | 500th | | 1,000th | | 2,000th | |
|---|---|---|---|---|---|---|---|---|---|
| | (%) | Ac.p | Con. | Ac.p | Con. | Ac.p | Con. | Ac.p | Con. |
| Ex. 18 | 50 | A | ⊙ | A | ⊙ | A | ⊙ | A | ⊙ |
| Ex. 19 | 45 | A | ⊙ | A | ⊙ | A | ⊙ | A | ⊙ |
| Ex. 20 | 40 | A | ⊙ | A | ⊙ | A | ⊙ | A | ⊙ |
| Ex. 21 | 30 | A | ⊙ | A | ⊙ | A | ⊙ | A | ⊙ |
| Ex. 22 | 65 | A | ⊙ | A | ⊙ | A | ○ | C | ○ |
| Ex. 23 | 59 | A | ⊙ | A | ⊙ | A | ○ | C | ○ |
| Ex. 24 | 25 | A | ⊙ | A | ⊙ | A | ○ | B | ○ |
| CEx. 11 | 71 | A | ⊙ | C | ○ | C | Δ | C | X |
| CEx. 12 | 21 | A | ○ | B | ⊙ | B | ○ | B | Δ |

Ex. = Example,
CEx. = Comparative Example
(Ac.p = Achromatized portion)
A: Complete erasing,
B: Incomplete erasing of an image,
C: Fogging caused by erasing
(Con. = Contrast)
⊙: at least 0.6,
○: at least 0.4 but less than 0.6,
Δ: at least 0.3 but less than 0.4,
X: less than 0.3

As clearly shown in in Table 4, resulsts similar to the results shown in Table 3 were obtained.

EXAMPLES 25–31

Example 18 was repeated except that the number of spots for forming an image was set at 400,000/cm$^2$ and that the ratio (%) of the number of spots for erasing to the number of spots for forming an image was set as shown in Table 5. Table 5 shows the results.

TABLE 5

| | RNOS | First | | 500th | | 1,000th | | 2,000th | |
|---|---|---|---|---|---|---|---|---|---|
| | (%) | Ac.p | Con. | Ac.p | Con. | Ac.p | Con. | Ac.p | Con. |
| Ex. 25 | 50 | A | ⊙ | A | ⊙ | A | ⊙ | A | ⊙ |
| Ex. 26 | 45 | A | ⊙ | A | ⊙ | A | ⊙ | A | ⊙ |
| Ex. 27 | 40 | A | ⊙ | A | ⊙ | A | ⊙ | A | ⊙ |
| Ex. 28 | 30 | A | ⊙ | A | ⊙ | A | ⊙ | A | ⊙ |
| Ex. 29 | 65 | A | ⊙ | A | ⊙ | A | ○ | C | ○ |
| Ex. 30 | 59 | A | ⊙ | A | ⊙ | A | ○ | C | ○ |
| Ex. 31 | 25 | A | ⊙ | A | ⊙ | A | ○ | B | ○ |
| CEx. 13 | 71 | A | ⊙ | C | ○ | C | Δ | C | X |
| CEx. 14 | 21 | A | ⊙ | B | ⊙ | B | ○ | B | Δ |

RNOS = Ratio of numbers of spots
Ex. = Example,
CEx. = Comparative Example
(Ac.p = Achromatized portion)
A: Complete erasing,
B: Incomplete erasing of an image,
C: Fogging
(Con. = Contrast)
⊙: at least 0.6,
○: at least 0.4 but less than 0.6,
Δ: at least 0.3 but less than 0.4,
X: less than 0.3

As clearly shown in Table 5, resulsts similar to the results shown in Tables 3 and 4 were obtained.

EXAMPLES 32–38 AND COMPARATIVE EXAMPLES 15 AND 16

Example 11 was repeated except that the ratio (%) of the laser output for erasing to the laser output for forming an image was set as shown in Table 6. Table 6 shows the results.

TABLE 6

| | RLO | First | | 500th | | 1,000th | | 2,000th | |
|---|---|---|---|---|---|---|---|---|---|
| | (%) | Ac.p | Con. | Ac.p | Con. | Ac.p | Con. | Ac.p | Con. |
| Ex. 32 | 50 | A | ⊙ | A | ⊙ | A | ⊙ | A | ○ |
| Ex. 33 | 45 | A | ⊙ | A | ⊙ | A | ⊙ | A | ⊙ |
| Ex. 34 | 40 | A | ⊙ | A | ⊙ | A | ⊙ | A | ⊙ |
| Ex. 35 | 30 | A | ⊙ | A | ⊙ | A | ⊙ | A | ⊙ |
| Ex. 36 | 65 | A | ⊙ | A | ⊙ | A | ○ | C | Δ |
| Ex. 37 | 59 | A | ⊙ | A | ⊙ | A | ○ | C | Δ |

TABLE 6-continued

| | RLO | First | | 500th | | 1,000th | | 2,000th | |
|---|---|---|---|---|---|---|---|---|---|
| | (%) | Ac.p | Con. | Ac.p | Con. | Ac.p | Con. | Ac.p | Con. |
| Ex. 38 | 25 | A | ◎ | A | ◎ | A | ○ | B | Δ |
| CEx. 15 | 71 | A | ◎ | C | ○ | C | Δ | C | X |
| CEx. 16 | 21 | A | ◎ | B | ◎ | B | ○ | B | Δ |

RLO = Ratio of laser outputs
(Ac.p = Achromatized portion)
A: Complete erasing,
B: Incomplete erasing of an image,
C: Fogging
(Con. = Contrast)
◎: at least 0.6,
○: at least 0.4 but less than 0.6,
Δ: at least 0.3 but less than 0.4,
X: less than 0.3

As clearly shown in Table 6, excellent results were obtained in Examples 32 to 35 until the color development and the achromatization were carried out at least 1,000 times repetitively.

EXAMPLE 29

A reversible thermal recording material was obtained in the same manner as in Example 11 except that the light-heat-converting dye (TX-EX-814, supplied by Nippon Shokubai Co., Ltd.) was replaced with YKR-3080 (supplied by YAMAMOTO CHEMICAL INC.) that was the same as the light-heat-converting dye used in Example 2.

The color development and the achromatization were carried out in the same manner as in Example 11 except that the semiconductor layer was replaced with a YAG laser and that the scanning rate for printing was changed to 250 cm/sec while the ratio of the scanning rate for erasing to the scanning rate for printing was changed in nine stages from 4.8 times to 1.4 times like Examples 11 to 17 and Comparative Examples 9 and 10. When the achromatization was carried out at a scanning rate that was at least 1.6 times but not more than 4 times the scanning rate for forming an image (printing), results similar to those in Examples 11 to 17 were obtained.

What is claimed is:

1. A reversible thermal recording material comprising a colorless or light-colored leuco dye, a reversible developer which causes said leuco dye to develop a color by heating and which achromatizes said leuco dye by re-heating, and a light-heat-converting dye, wherein said light-heat-converting dye has a deterioration ratio of 20% or less when a laser beam having an oscillation wavelength of 830 nm is applied thereto repeatedly 1000 times at a temperature of 25° C. at an energy of 2 J/cm$^2$, wherein the leuco dye, the reversible developer and the light-heat-converting dye are contained in one and the same layer.

2. A reversible thermal recording material comprising a colorless or light-colored leuco dye, a reversible developer which causes said leuco dye to develop a color by heating and which achromatizes the leuco dye by re-heating, and a light-heat-converting dye, wherein the light-heat-converting dye is a phthalocyanine compound having a vanadyl group, wherein the leuco dye, the reversible developer and the light-heat-converting dye are contained in one and the same layer.

3. The reversible thermal recording material of claim 2, wherein the phthalocyanine compound having a vanadyl group has at least four substituents, each of which is independently selected from an alkyl group, a substituent having an ether bond or a substituent having a thioether bond.

4. A method of recording an image by applying a laser beam to a reversible thermal recording material comprising a colorless or light-colored leuco dye, a reversible developer which causes said leuco dye to develop a color by heating and which achromatizes the leuco dye by re-heating and a light-heat-converting dye, to record an image by heat generated by the application of the laser beam, wherein said leuco dye is achromatized with energy that is at least 25% but not more than 65% of the energy of the laser beam applied for causing said leuco dye to develop a color, wherein the leuco dye, the reversible developer and the light-heat-converting dye are contained in one and the same layer.

5. The method of claim 4, wherein the colored leuco dye is achromatized by heat generated by the application of a laser beam.

6. The method of claim 4, wherein the colored leuco dye is achromatized by applying a laser beam for a time period that is at least 25% but not more than 65% of a time period required for applying the laser beam to cause the leuco dye to develop a color.

7. The method of claim 4, wherein the colored leuco dye is achromatized by applying a laser beam having a pulse width that is at least 25% but not more than 65% of the width of the laser beam applied for causing the leuco dye to develop a color.

8. The method of claim 4, wherein the colored leuco dye is achromatized with a laser beam at a scanning rate that is at least 1.6 times but not more than 4 times the scanning rate of the laser beam applied for causing the leuco dye to develop a color.

9. The method of claim 4, wherein the colored leuco dye is achromatized with that number of spots of a laser beam which is at least 25% but not more than 65% of the number of spots of the laser beam applied for causing the leuco dye to develop a color.

10. The method of claim 4, wherein the colored leuco dye is achromatized by heat generated by the application of a laser beam from a laser having a beam emission region at at least 800 nm but not more than 1,200 nm.

* * * * *